US012559692B2

(12) United States Patent
Karimi et al.

(10) Patent No.: US 12,559,692 B2
(45) Date of Patent: Feb. 24, 2026

(54) LOW SULFUR MARINE FUEL COMPOSITIONS

(71) Applicants: CHEVRON SINGAPORE PTE. LTD., Singapore (SG); CHEVRON BELGIUM BV, Ghent (BE)

(72) Inventors: Nayab Karimi, Singapore (SG); Monique B. Vermeire, Lochristi (BE); Boon Hui Tan, Singapore (SG)

(73) Assignees: Chevron Singapore Pte. Ltd., Singapore (SG); Chevron Belgium BV, Ghent (BE)

( * ) Notice: Subject to any disclaimer, the term of this patent is extended or adjusted under 35 U.S.C. 154(b) by 0 days.

(21) Appl. No.: 18/694,523

(22) PCT Filed: Sep. 24, 2021

(86) PCT No.: PCT/EP2021/076401
§ 371 (c)(1),
(2) Date: Mar. 22, 2024

(87) PCT Pub. No.: WO2023/046296
PCT Pub. Date: Mar. 30, 2023

(65) Prior Publication Data

US 2025/0043202 A1 Feb. 6, 2025

(51) Int. Cl.

| | |
|---|---|
| ***C10L 1/19*** | (2006.01) |
| ***C10L 1/02*** | (2006.01) |
| ***C10L 1/04*** | (2006.01) |

(52) U.S. Cl.
CPC ..... *C10L 1/19* (2013.01); *C10L 1/02* (2013.01); *C10L 1/04* (2013.01); *C10L 2200/0438* (2013.01); *C10L 2200/0476* (2013.01); *C10L 2270/026* (2013.01)

(58) Field of Classification Search
CPC ..... C10L 1/02; C10L 1/04; C10L 1/19; C10L 2200/0438; C10L 2200/0476; C10L 2270/026
See application file for complete search history.

(56) References Cited

U.S. PATENT DOCUMENTS

| | | | | |
|---|---|---|---|---|
| 2011/0232169 | A1 | 9/2011 | Cherrillo | |
| 2021/0363445 | A1 * | 11/2021 | Kar | C10L 1/02 |
| 2022/0411702 | A1 * | 12/2022 | Sarjovaara | C10G 3/46 |

FOREIGN PATENT DOCUMENTS

| | | | | |
|---|---|---|---|---|
| JP | 2007231119 | A | 9/2007 | |
| WO | 2020109653 | W | 6/2020 | |
| WO | WO-2021094658 | A1 * | 5/2021 | C10G 3/00 |

OTHER PUBLICATIONS

PCT International Search Report mailed on Jun. 15, 2022, issued in International Application No. PCT/EP2021/076401, filed on Sep. 24, 2021, 13 pages.

* cited by examiner

*Primary Examiner* — Latosha Hines
(74) *Attorney, Agent, or Firm* — Jason M. Guerrero

(57) ABSTRACT

A marine bunker fuel composition is disclosed. The composition is compliant with fuel standard ISO 8217—2017 Table 2 and contains at least 70 vol % of a marine fuel oil blendstock and from 1 vol % to 30 vol % of a fatty acid alkyl ester.

10 Claims, No Drawings

LOW SULFUR MARINE FUEL COMPOSITIONS

CROSS-REFERENCE TO RELATED APPLICATIONS

This application is a national stage application (under 35 U.S.C. § 371) of International Application No. PCT/EP2021/076401, filed Sep. 24, 2021, which is incorporated herein by reference in its entirety.

This disclosure relates to marine fuel compositions, and more particularly to renewable marine fuel blends.

BACKGROUND

Marine fuel compositions, sometimes referred to as bunker fuel, have conventionally included heavy gas oils that may be otherwise difficult and/or expensive to convert to a beneficial use. The heavy gas oils may include heavier distillation fractions that are lightly processed (or even unprocessed), such as vacuum gas oils, heavy atmospheric gas oil, and residual components. Due in part to use of the marine fuel compositions in international waters, the fuels have typically incorporated heavy gas oils with relatively high sulfur content. However, many countries have recently adopted local specifications for lower sulfur emissions from marine vessels. In addition, the International Maritime Organization (IMO) has implemented a new global sulfur limit of 0.50 wt. % sulfur, effective Jan. 1, 2020, commonly referred to as "IMO 2020". In addition to IMO 2020, marine fuel compositions classified as residual marine fuels should meet the requirements of ISO 8217, Fuel Standard Sixth Edition 2017, Table 2, while marine fuel compositions classified as distillate marine fuels should meet the requirements of ISO 8217, Fuel Standard Sixth Edition 2017, Table 1.

In recent years, there have also been significant concerns about greenhouse gas ("GHG") emissions and their effect on climate. GHGs, especially carbon dioxide, but also methane and nitrous oxide, trap heat in the atmosphere and thus contribute to climate change. One of the largest sources of GHG emissions is the production and use of fossil fuels for transportation, heating and electricity generation.

In 2018, the IMO adopted an initial strategy on the reduction of GHG emissions from international shipping. This envisages a reduction in carbon intensity of international shipping (to reduce $CO_2$ emissions per transport work, as an average across international shipping, by at least 40% by 2030, pursuing efforts towards 70% by 2050, compared to 2008); and that total annual GHG emissions from international shipping should be reduced by at least 50% by 2050 compared to 2008.

Displacing fossil-based fuel with renewable derived fuel creates GHG benefits by displacing $CO_2$ emissions that would have originated from the fossil fuel. It would be desirable to develop compositions containing renewable components that are suitable for use as low sulfur marine fuels which meet quality requirements and provide a beneficial GHG emission impact.

SUMMARY

In a first aspect, there is provided a marine bunker fuel composition comprising: (a) at least 70 vol % of a marine fuel oil blendstock; and (b) from 1 vol % to 30 vol % of a fatty acid alkyl ester; wherein the marine bunker fuel composition is compliant with fuel standard ISO 8217—2017 Table 2.

In a second aspect, there is provided a method for operating a two-stroke or four-stroke marine diesel engine, the method comprising fueling the engine with a marine bunker fuel composition comprising: (a) at least 70 vol % of a marine fuel oil blendstock; and (b) from 1 vol % to 30 vol % of a fatty acid alkyl ester; wherein the marine bunker fuel composition is compliant with fuel standard ISO 8217—2017 Table 2.

DETAILED DESCRIPTION

Definitions

The term "fatty acid" is meant to encompass a monocarboxylic acid having an aliphatic chain, wherein the aliphatic chain may be either saturated, mono-unsaturated (e.g., having one double bond anywhere on the aliphatic chain) or polyunsaturated (e.g., having two, three or more double bonds anywhere on the aliphatic chain). Fatty acids can have from 4 to 30 carbon atoms.

The term "Cn" is to be understood to refer to hydrocarbon molecules having "n" number of carbon atoms per molecule. Similarly, the term "Cn−" refers to hydrocarbon molecules that contain less than or equal to "n" carbon atoms per molecule. The term "Cn+" refers to molecules with more than or equal to "n" carbon atoms per molecule.

Marine Fuel Oil Blendstock

The marine fuel oil blendstock can be any petroleum-based marine resid-containing fuel oil intended to be consumed in marine engines. Examples of hydrocarbon fractions useful as the marine fuel oil blendstock component can include kerosene, diesel, high sulfur fuel oil (HSFO), low sulfur fuel oil (LSFO), fluid catalytic cracker slurry oil, heavy coker gas oil (HCGO), light cycle oil (LCO), vacuum tower bottoms (VTB), atmospheric tower bottoms (ATB), low sulfur straight-run fuel oil (LSSR), high sulfur straight-run (HSSR), distillate base stock (DBS), low sulfur vacuum gas oil (LSVGO), high sulfur vacuum gas oil (HSVGO), cracked or straight-run fuel oil (M100), straight-run gas oil (SRGO), ultra-low sulfur heating oil (ULSHO), residues, fractionated (but otherwise untreated) crude oil, and combinations thereof. Examples of residues include straight-run residues, thermal residues, cracked residues, and combinations thereof.

The resid-containing fuel oil can include 1.0 wt. % or more of 370° C.+ components.

The marine fuel oil blendstock can have a sulfur content of 0.50 wt. % or less (e.g., 0.30 wt. % or less, 0.10 wt. %, such as down to 0.050 wt. % or possibly still lower). Alternatively or additionally, the marine fuel oil blendstock may have a sulfur content in a range of from 0.050 wt. % to 0.50 wt. % (e.g., 0.10 wt. % to 0.50 wt. %, 0.050 wt. % to 0.30 wt. %, or 0.050 wt. % to 0.10 wt. %).

The marine blendstock fuel oil can further have one or more of the following properties.

The blendstock can have a minimum kinematic viscosity at 50° C. (KV50) of 10 $mm^2/s$, 20 $mm^2/s$, 30 $mm^2/s$, 40 $mm^2/s$, 50 $mm^2/s$, 60 $mm^2/s$, 70 $mm^2/s$, 80 $mm^2/s$, 90 $mm^2/s$, 100 $mm^2/s$, 110 $mm^2/s$, 120 $mm^2/s$, 130 $mm^2/s$, or 140 $mm^2/s$; alternatively or additionally, a maximum KV50 of 1000 $mm^2/s$, 900 $mm^2/s$, 800 $mm^2/s$, 700 $mm^2/s$, 500 $mm^2/s$, 380 $mm^2/s$, 200 $mm^2/s$, 180 $mm^2/s$ or 150 $mm^2/s$. Generally, the KV50 can be in a range from any minimum KV50 disclosed herein to any maximum KV50 disclosed herein.

The blendstock can have a minimum density at 15° C. of 800 $kg/m^3$, 810 $kg/m^3$, 820 $kg/m^3$, 830 $kg/m^3$, 840 $kg/m^3$, 850 kg/m$^3$, 860 kg/m$^3$, 870 kg/m$^3$, 880 kg/m$^3$, 890 kg/m$^3$, 900 kg/m$^3$, 910 kg/m$^3$, or 920 kg/m$^3$; alternatively or additionally, a maximum density at 15° C. of 1100 kg/m$^3$, 1000 kg/m$^3$, 990 kg/m$^3$, 980 kg/m$^3$, 970 kg/m$^3$, 960 kg/m$^3$, 950 kg/m$^3$, 940 kg/m$^3$, or 930 kg/m$^3$. Generally, the density can be in a range from any minimum density disclosed herein to any maximum density disclosed herein.

The blendstock can have minimum pour point of −30° C., −25° C., −20° C., −15° C., −10° C., −5° C., or 0° C.; alternatively or additionally, a maximum pour point of 30° C., 25° C., 20° C., 15° C., 10° C., or 5° C. Generally, the pour point can be in a range from any minimum pour point disclosed herein to any maximum pour point disclosed herein.

The blendstock can have a calculated carbon aromaticity index (CCAI) value of 870 or less (e.g., 850 or less, 750 to 870, or 800 to 870).

In some aspects, the marine fuel oil blendstock can correspond to a residual marine fuel composition that is compliant with fuel standard ISO 8217-2017 Table 2.

The minimum amount of marine fuel oil blendstock in the marine bunker fuel composition can be 70 vol %, 75 vol %, or 80 vol %, based on the total volume of the marine bunker fuel composition; additionally or alternately, the maximum amount can be 99 vol %, 98 vol %, 97 vol %, 96 vol %, 95 vol %, 94 vol %, 93 vol %, 92 vol %, 91 vol %, or 90 vol %, based on the total weight of the marine fuel composition. Generally, the amount of marine fuel oil blendstock in the marine bunker fuel composition can be in a range from any minimum amount disclosed herein to any maximum amount disclosed herein.

Fatty Acid Alkyl Ester

The fatty acid alkyl ester can be obtained using conventional techniques of transesterification of a natural oil with an alkyl alcohol (e.g., methyl alcohol). A "natural oil", as used herein, is an oil composed of fatty acid triglycerides and derived from a microbe (algae, bacteria), a plant, and/or an animal source. Natural oils do not include petroleum-derived oils. Examples of suitable natural oils include algae oils, beef tallow oil, canola oil, castor oil, corn oil, fish oil, linseed oil, palm oil, palm oil mill effluent, rapeseed oil, safflower oil, soybean oil, sunflower oil, used cooking oil, and any combination thereof. In various embodiments, the fatty acid alkyl ester can be derived from used cooking oil and/or palm oil mill effluent. Alternatively, esterification of fatty acids with alkyl alcohols can be used to prepare the fatty acid alkyl ester.

The length of the fatty acid carbon chain of the fatty acid alkyl ester is not particularly limited. In various embodiments, the length of the fatty acid carbon chain can be from 10 to 24 carbon atoms, such as from 12 to 20 carbon atoms, or from 12 to 18 carbon atoms. When referring to the number of carbon atoms in the fatty acid chain, the carbonyl carbon of the fatty acid is intended to be included. In various aspects, fatty acid alkyl ester molecules having a carbon chain length of at least 14 carbon atoms (e.g., at least 16 carbon atoms) can constitute at least 50 wt. %, at least 60 wt. %, at least 70 wt. %, at least 80 wt. %, at least 90 wt. %, at least 99 wt. %, all or substantially all of the fatty acid alkyl ester.

The alkyl moiety of the fatty acid alkyl ester is not particularly limited. The alkyl moiety of the ester may be a methyl group, an ethyl group, or a propyl group. In one aspect, the alkyl moiety of the fatty acid alkyl ester is a methyl group. Accordingly, in various aspects, the fatty acid alkyl ester is a fatty acid methyl ester (FAME).

Examples of fatty acid methyl esters include canola methyl ester, corn oil methyl ester, palm oil mill effluent methyl ester (POMEME), rapeseed methyl ester (RME), soy methyl ester, sunflower oil methyl ester, used cooking oil methyl ester (UCOME), and any combination thereof. In some aspects, the fatty acid methyl ester is a used cooking oil methyl ester, a palm oil mill effluent methyl ester, or a combination thereof.

The fatty acid alkyl ester can exhibit one or more of the following properties.

The fatty acid alkyl ester can have a minimum kinematic viscosity at 50° C. (KV50) of 2.9 mm$^2$/s, 3.0 mm$^2$/s, 3.1 mm$^2$/s; 3.2 mm$^2$/s, 3.3 mm$^2$/s, 3.4 mm$^2$/s, 3.5 mm$^2$/s; 3.6 mm$^2$/s, or 3.7 mm$^2$/s; additionally or alternatively, a maximum KV50 of 4.0 mm$^2$/s, 3.9 mm$^2$/s, or 3.8 mm$^2$/s. Generally, the KV50 can be in a range from any minimum KV50 disclosed herein to any maximum KV50 disclosed herein.

The fatty acid alkyl ester can have a minimum density at 15° C. of 860 kg/m$^3$, 865 kg/m$^3$, 870 kg/m$^3$, or 875 kg/m$^3$; additionally or alternatively, a maximum density of 900 kg/m$^3$, 885 kg/m$^3$, or 880 kg/m$^3$. Generally, the density can be in a range from any minimum density disclosed herein to any maximum density disclosed herein.

The fatty acid alkyl ester may have a sulfur content of 100 mg/kg or less (e.g., 90 mg/kg or less, 80 mg/kg or less, 70 mg/kg or less, 60 mg/kg or less, 50 mg/kg or less, 40 mg/kg or less, 30 mg/kg or less, 20 mg/kg or less, or 10 mg/kg or less).

Additionally or alternatively, the fatty acid alkyl ester can exhibit at least one of the following properties: a flash point of 101° C. or more (e.g., 120° C. or more, such as up to 200° C.); an acid number of at most 0.5 mg KOH per gram; and a water content of 500 mg/kg or less (e.g., 400 mg/kg or less, 300 mg/kg or less, 200 mg/kg or less, or 100 mg/kg or less).

The fatty acid alkyl ester can be included in the marine bunker fuel composition in any suitable concentration, to provide the marine bunker fuel composition with desirable properties. The minimum amount of fatty acid alkyl ester in the marine bunker fuel composition can be 1 vol %, 2 vol %, 3 vol %, 4 vol %, 5 vol %, 6 vol %, 7 vol %, 8 vol %, 9 vol %, or 10 vol %, based on the total volume of the marine fuel composition; additionally or alternatively, the maximum amount can be 30 vol %, 25 vol %, or 20 vol %, based on the total volume of the marine fuel composition. Generally, the amount of fatty acid alkyl ester can be in a range from any minimum amount disclosed herein to any maximum amount disclosed herein.

Marine Bunker Fuel Composition

The marine bunker fuel composition can correspond to a marine residual fuel composition that is compliant with fuel standard ISO 8217—2017 Table 2.

The marine bunker fuel composition can have a sulfur content of 0.50 wt. % or less. Examples of suitable marine bunker fuel compositions may have a sulfur content of from 0.0001 wt. % to 0.50 wt. % (e.g., 0.0001 wt. % to 0.05 wt. %, 0.01 wt. % to 0.1 wt. %, 0.05 wt. % to 0.50 wt. %, or 0.40 wt. % to 0.49 wt. %).

The marine bunker fuel composition can have a minimum kinematic viscosity at 50° C. (KV50) of 10 mm$^2$/s, 20 mm$^2$/s, 30 mm$^2$/s, 40 mm$^2$/s, 50 mm$^2$/s, 60 mm$^2$/s, 70 mm$^2$/s, 80 mm$^2$/s, 90 mm$^2$/s, 100 mm$^2$/s, 110 mm$^2$/s, 120 mm$^2$/s, 130 mm$^2$/s, or 140 mm$^2$/s; alternatively or additionally, a maximum KV50 of 700 mm$^2$/s, 500 mm$^2$/s, 380 mm$^2$/s, 200 mm$^2$/s, 180 mm$^2$/s or 150 mm$^2$/s. Generally, the KV50 can be in a range from any minimum KV50 disclosed herein to any maximum KV50 disclosed herein.

The marine bunker fuel composition can have a minimum density at 15° C. of 800 kg/m$^3$, 810 kg/m$^3$, 820 kg/m$^3$, 830 kg/m$^3$, 840 kg/m$^3$, 850 kg/m$^3$, 860 kg/m$^3$, 870 kg/m$^3$, 880 kg/m$^3$, 890 kg/m$^3$, 900 kg/m$^3$, or 910 kg/m$^3$; additionally or alternatively, a maximum density of 1010 kg/m$^3$, 991 kg/m$^3$, 975 kg/m$^3$, 960 kg/m$^3$, or 920 kg/m$^3$. Generally, the density can be in a range from any minimum density disclosed herein to any maximum density disclosed herein.

The marine bunker fuel composition can have a minimum pour point of −30° C., −25° C., −20° C., −15° C., −10° C., −5° C., 0° C., 5° C., or 10° C.; additionally or alternatively, a maximum pour point of 30° C., 25° C., 20° C., or 15° C. Generally, the pour point can be in a range from any minimum pour point disclosed herein to any maximum pour point disclosed herein.

Additionally or alternatively, the marine bunker fuel composition can exhibit at least one of the following properties: a flash point of 60° C. or more (e.g., 80° C. or more, 100° C. or more, 120° C. or more, such as up to 200° C.); a calculated carbon aromaticity index (CCAI) value of 870 or less (e.g., 860 or less, 850 or less, 750 to 870, 750 to 860, 750 to 850, 800 to 870, 800 to 860, or 800 to 850); an acid number of at most 2.5 mg KOH per gram; and a water content of 0.50 vol % or less (e.g., 0.30 vol %, or less).

The marine bunker fuel compositions described herein can be used in various types of diesel engines (e.g., a two-stroke or four-stroke marine diesel engine) that may be present on a marine vessel that operates (at least in part) based on marine fuel oil. Engines that can be operated using marine fuel oil include marine engines for movement of a vessel and electrical generators for providing electrical power on a vessel.

EXAMPLES

The following illustrative examples are intended to be non-limiting.

Example 1

In order to demonstrate the benefits of use of a fatty acid alkyl ester with a fuel oil, a fuel oil blend was formed from 90 vol % of a very low sulfur fuel oil (VLSFO) and 10 vol % of a used cooking oil methyl ester (UCOME). Table 1 shows the properties of the blending components and the fuel blend.

TABLE 1

| Property | Test Method | VLSFO | UCOME | 90% VLSFO/ 10% UCOME |
|---|---|---|---|---|
| Density at 15° C. [kg/m$^3$] | ISO 3675 or ISO 12185 | 970.9 | 876.9 | 959.7 |
| KV50 [mm$^2$/s] | ISO 3104 | 115.3 | 3.73 | 61.96 |
| Sulfur [mass %] | ISO 8754 or ISO 14596 or ASTM D4294 | 0.48 | <0.0017 | 0.42 |
| Pour Point [° C.] | ISO 3016 | 3 | 12 | 3 |
| Flash Point [° C.] | ISO 2719 | 74.0 | >101 | >74.0 |
| Water [vol %] | ISO 3733 | 0.40 | <0.05 | 0.25 |
| MCR [mass %] | ISO 10370 | 6.78 | — | <6.78 |
| TSP/TSE [mass %] | ISO 10307-2 | 0.02 | <0.01 | 0.02 |
| Ash [mass %] | ISO 6245 | 0.024 | — | <0.024 |
| Sodium [mg/kg] | IP 501 or IP 470 | 13 | — | <13 |
| Vanadium [mg/kg] | IP 501 or IP 470 or ISO 14597 | 12 | — | <12 |
| Aluminum + Silicon [mg/kg] | IP 501 or IP 470 or ISO 10478 | 44 | — | <44 |
| Calcium [mg/kg] | IP 501 or IP 470 or IP 500 | 4 | — | <4 |
| Zinc [mg/kg] | IP 501 or IP 470 or IP 500 | <1 | — | <1 |
| Phosphorus [mg/kg] | IP 500 | <1 | — | <1 |
| CCAI | ISO 8217, ANNEX B | <870 | N/A | <870 |
| Acid Number [mg KOH/g] | ASTM D664 | 0.69 | 0.36 | 0.66 |
| Hydrogen Sulfide [mg/kg] | IP 570 | <0.60 | — | <0.60 |

Table 1 shows that a low carbon intensity fatty acid alkyl ester fraction can be used as a drop-in fuel with a conventional marine fuel oil to form a blend that meets ISO 8217—2017 Table 2 fuel quality requirements.

The invention claimed is:

1. A marine bunker fuel composition consisting of:

(a) at least 70 vol % of a petroleum-based marine fuel oil blendstock, wherein the petroleum-based marine fuel oil blendstock is a resid-containing fuel oil; and (b) from 1 vol % to 30 vol % of a fatty acid alkyl ester; wherein the marine bunker fuel composition is compliant with fuel standard ISO 8217—2017 Table 2.

2. The marine fuel oil composition of claim 1, wherein the resid-containing fuel oil comprises 1.0 wt. % or more of components with boiling points of 370° C. or more.

3. The marine bunker fuel composition of claim 1, wherein the petroleum-based marine fuel oil blendstock has a sulfur content of 0.50 wt. % or less.

4. The marine bunker fuel composition of claim 1, wherein the petroleum-based marine fuel oil blendstock is a marine residual fuel composition that is compliant with fuel standard ISO 8217—2017 Table 2.

5. The marine fuel composition of claim 1, wherein the fatty acid alkyl ester comprises fatty acid alkyl ester molecules having a carbon chain length of at least 14 carbon atoms in an amount of at least 50 wt. %, based on a total weight of the fatty acid alkyl ester.

6. The marine fuel composition of claim 1, wherein the fatty acid alkyl ester comprises a fatty acid methyl ester.

7. The marine fuel oil composition of claim 6, wherein the fatty acid methyl ester comprises palm oil mill effluent methyl ester, used cooking oil methyl ester, or a combination thereof.

8. The marine bunker fuel composition of claim 1, wherein the fatty acid alkyl ester is present in an amount of from 1 vol % to 20 vol % of the marine bunker fuel composition.

9. A method for operating a two-stroke or four-stroke marine diesel engine, the method comprising fueling the engine with the marine bunker fuel composition of claim 1.

10. The marine bunker fuel composition of claim 1, which has a sulfur content of 0.50 wt. % or less.

* * * * *